US007066239B2

(12) United States Patent
Jung

(10) Patent No.: US 7,066,239 B2
(45) Date of Patent: Jun. 27, 2006

(54) AIR HYPOCAUST STRUCTURE FOR COOLING AND/OR HEATING

(75) Inventor: Hak-mo Jung, Seoul (KR)

(73) Assignee: Hastopia Shinyung Co., Ltd., Seoul (KR)

( * ) Notice: Subject to any disclaimer, the term of this patent is extended or adjusted under 35 U.S.C. 154(b) by 262 days.

(21) Appl. No.: 10/652,625

(22) Filed: Aug. 29, 2003

(65) Prior Publication Data

US 2004/0194919 A1 Oct. 7, 2004

(30) Foreign Application Priority Data

Apr. 1, 2003 (KR) ..... 20-2003-0009795

(51) Int. Cl.

| | |
|---|---|
| ***F24D 3/12*** | (2006.01) |
| ***F24D 15/02*** | (2006.01) |
| ***F24D 13/04*** | (2006.01) |
| ***F24D 3/16*** | (2006.01) |
| ***F24H 3/04*** | (2006.01) |

(52) U.S. Cl. ..... 165/56; 165/53; 237/69; 219/213

(58) Field of Classification Search ..... 165/53, 165/56; 237/69; 219/213
See application file for complete search history.

(56) References Cited

U.S. PATENT DOCUMENTS 4,820,903 A * 4/1989 Ishida ..... 219/213

FOREIGN PATENT DOCUMENTS

| | | | |
|---|---|---|---|
| DE | 3003341 A | * | 8/1981 |
| JP | 06147515 A | * | 5/1994 |
| JP | 2004308401 A | * | 11/2004 |
| KR | 1003097100000 B1 | | 9/2001 |

* cited by examiner

*Primary Examiner*—John K. Ford
(74) *Attorney, Agent, or Firm*—IP Strategies

(57) ABSTRACT

Disclosed is herein an air hypocaust structure for cooling and/or heating dwellings. In winter, hot air is supplied into a space between an upper and a base plate constituting the air hypocaust structure to heat the dwelling according to a convection and a radiation mechanism. In summer, cold air is supplied to the space between the upper and base plate to cool the dwelling according to the convection mechanism. A plurality of support legs and guide plates are installed between the upper and base plate, and the support legs and guide plates may be integrally formed on the lower side of the upper plate or may be separately produced to be assembled with the upper plate. A hole is formed at a lower end of each of the support legs, and projections each having a sharp tip at an end thereof and corresponding in position to the support legs are formed on the upper side of the base plate. Therefore, when the upper plate is assembled with the base plate, the sharp tips of the projections are inserted into the holes of the support legs to firmly assemble the upper plate with the base plate. Furthermore, the guide plates are arranged between the upper and base plate to control the direction of a hot or cold air current flowing through the air hypocaust structure.

3 Claims, 6 Drawing Sheets

AIR HYPOCAUST STRUCTURE FOR COOLING AND/OR HEATING

BACKGROUND OF THE INVENTION

1. Field of the Invention

The present invention pertains to an air hypocaust structure for cooling and/or heating a dwelling. More particularly, the present invention relates to an air hypocaust structure, which is installed on an insulating material mounted on a floor so as to cool and/or heat a dwelling using cold or hot air. The air hypocaust structure includes a base plate provided with projections positioned along an edge thereof at regular intervals, an upper plate integrally provided with a plurality of support legs each having a hole at an end thereof and corresponding in position to the projections of the base plate, and a plurality of guide plates positioned between the upper plate and base plate in such a way that the upper ends of the guide plates are fixed into recess parts of the upper plate and bases provided at the lower ends of the guide plates come into contact with an upper side of the base plate. When the cold or hot air flows between the upper plate and base plate, the current of the cold or hot air is controlled by the guide plates which are arranged as desired.

2. Description of the Related Art

Generally, a dwelling having a hypocaust system is heated by hot water flowing through a pipe installed in a floor, and cooled by an air conditioner.

However, if the pipe for allowing the hot water to flow therethrough is antiquated, they are easily blocked or corroded, and leak. Furthermore, when the pipe is installed in the floor, a large amount of concrete must be used to cover the pipe so as to protect the pipe from an external impact, thus a concrete layer surrounding the pipe must be thick, thereby reducing the heat transfer efficiency of the hypocaust system. To increase the heat transfer efficiency through the concrete layer, the thickness of the concrete layer surrounding the pipe must be thin. However, when the thickness of the concrete layer is thin, the pipe may be easily broken by the external impact, and thus a lot of labor and repair costs are needed to repair the broken pipe.

The present invention improves Korean Invention Registration No. 0309710, entitled "method for constructing heating and cooling system" and filed by and allowed to the inventor of the present invention, in which a heat transfer rate through a concrete layer is slow and the heat dissipation through the concrete layer is considerable because a part of the concrete layer positioned in a recess part of an uneven panel constituting the hypocaust structure is thick. Furthermore, in Korean Invention Registration No. 0309710, entitled "method for constructing heating and cooling system", a cold or hot air current flows linearly in the air hypocaust structure. The improvement, accomplished by the present invention, is to selectively change a flow direction of a cold or hot air current in the hypocaust structure.

SUMMARY OF THE INVENTION

Accordingly, it is an aspect of the present invention to overcome the disadvantages, and to provide an air hypocaust structure including an upper plate integrally provided with a plurality of support legs, a base plate integrally provided with projections which correspond in position to the support legs and have sharp tips at the ends thereof, and straight or curved guide plates selectively installed between the upper and base plate in such a way that the upper ends of the guide plates are fixed into the recess parts of the upper plate using locking pieces, and bases provided at lower ends of the guide plates come into contact with an upper side of the base plate. At this time, the upper plate is assembled with the base plate in such a way that the sharp tips of the projections of the base plate are engaged into the hollow support legs of the upper plate through the holes of the support legs. Furthermore, the straight or curved guide plates may be used to desirably guide a flow direction of a hot or cold air current, thereby work efficiency is improved in installing the air hypocaust structure in a house and the heat transfer efficiency of the air hypocaust structure is improved.

The guide plates are installed between the upper plate and base plate while the projections are engaged into the holes of the support legs.

Further, each of the guide plates is made of a very soft, highly elastic material, so that the upper ends of the guide plates are easily fixed into the recess parts of the upper plate.

BRIEF DESCRIPTION OF THE DRAWINGS

This and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
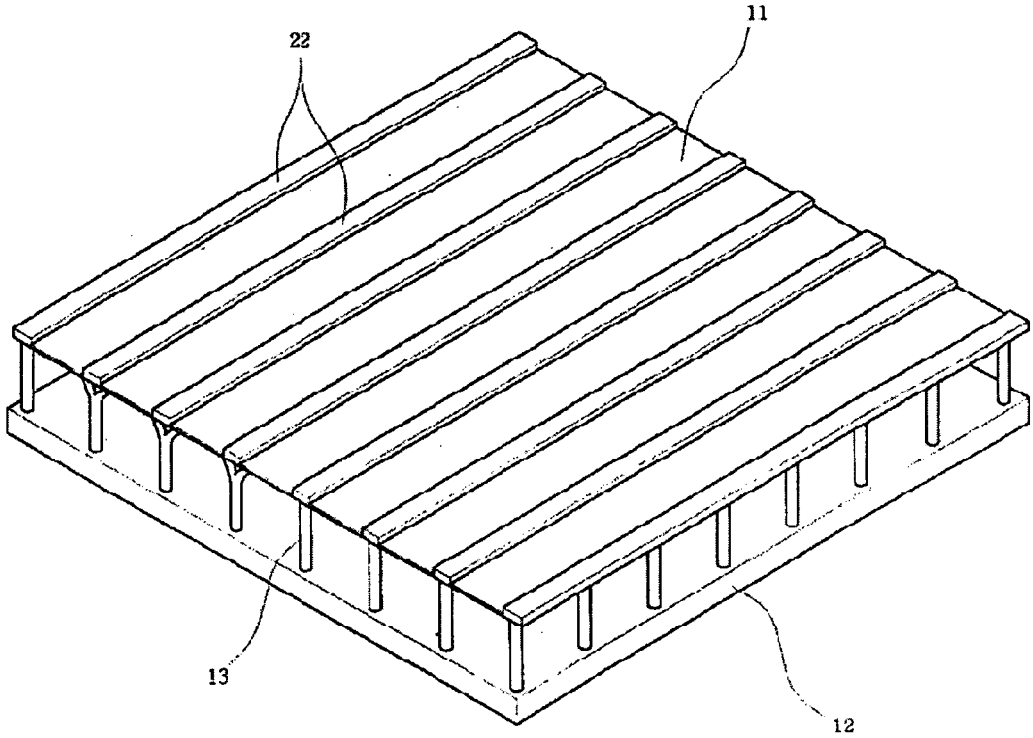
FIG. 1 is a perspective view of an air hypocaust structure for cooling and heating according to the present invention.

Reference will now be made in detail to the present preferred embodiments of the present invention, examples of which are illustrated in the accompanying drawings, wherein like reference numerals refer to like elements throughout.

Figure 2:
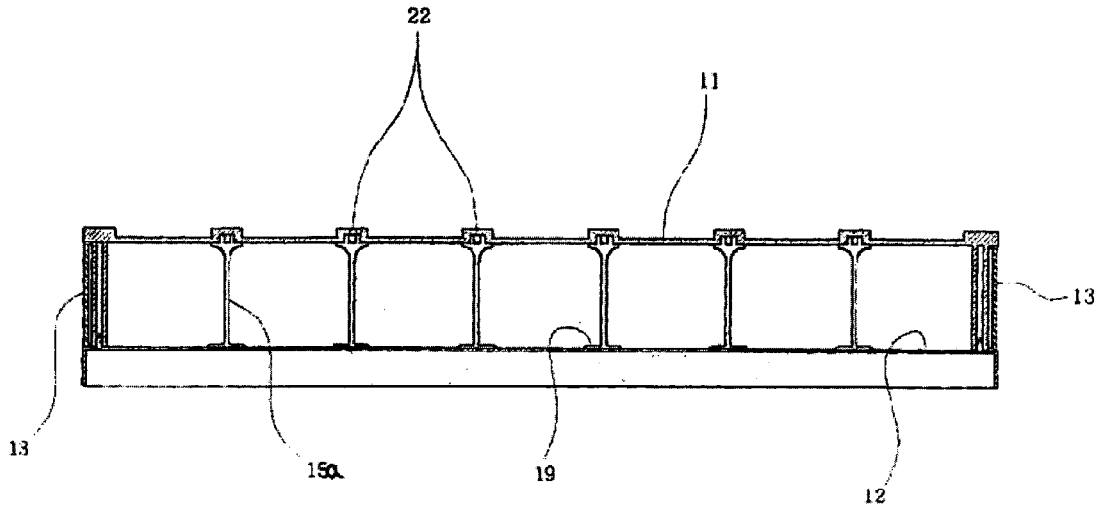
FIG. 2 is a sectional view of the air hypocaust structure of FIG. 1.

As shown in FIGS. 1 and 2, the present invention is characterized in that an air hypocaust structure includes an upper plate 11 having a plurality of recess parts 17 positioned at regular intervals, and integrally provided with a plurality of support legs 13 positioned along an edge thereof at regular intervals, a base plate 12 provided with a plurality of projections 14 corresponding in position to the support legs 13, and a plurality of curved and straight guide plates 15*a* and 15*b* selectively installed between the upper plate 11 and the base plate 12, thereby controlling a flow direction of a cold or a hot air current.

By the use of the air hypocaust structure according to the present invention, a dwelling is cooled or heated by a conduction, convection, and radiation mechanism of the air current.

In other words, the air hypocaust structure according to the present invention is installed in the dwelling, and cools or heats the dwelling using the cold or hot air current supplied from a main air supply system (not shown).

As shown in FIG. 1, the upper plate 11 has a predetermined size, comes into contact with other upper plates at sides thereof, and is connected to other upper plates using appropriate connection members (not shown).

Each of the support legs 13 has a hole 16 at an end thereof, and the guide plates 15, comprising the curved and straight guide plates 15*a* and 15*b*, are fixed at the upper ends thereof into the recess parts 17 of the upper plate 11 using the locking pieces, and come into contact with the upper side of the base plate 12 through the bases provided at the lower ends thereof.

Figure 3:
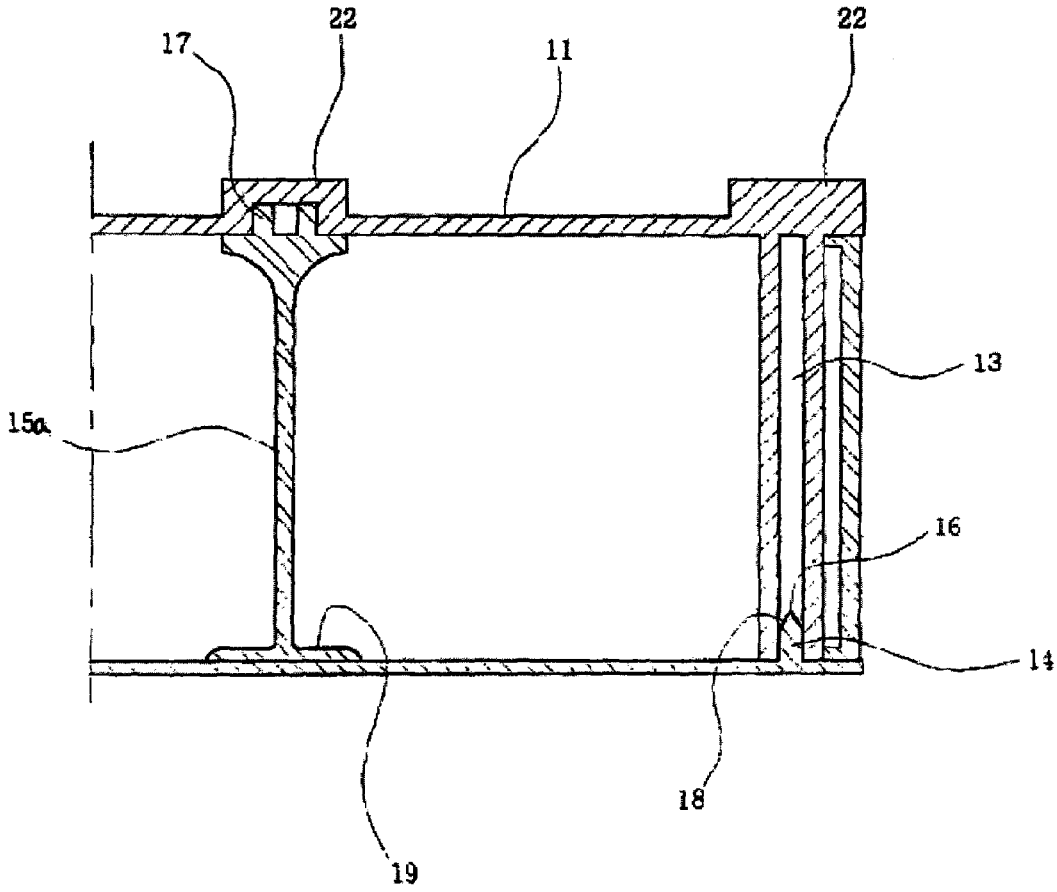
FIG. 3 is a partially enlarged view of the air hypocaust structure of FIG. 1.

With reference to FIG. 3, a plurality of protrusion parts 22 formed on an upper side of the upper plate 11 are each extended from one side to the opposite side of the upper plate 11 in a shape of straight long rectangle, and a finishing material (not shown) is placed between the protrusions 22. Additionally, the recess parts 17 are formed on a lower side of the upper plate 11 at regular intervals, the hole 16 is formed at the end of each support leg 13, and the sharp tips 18 are formed at the ends of the projections 14 of the base plate 12, as shown in FIGS. 4A and 4B.

Figure 5:
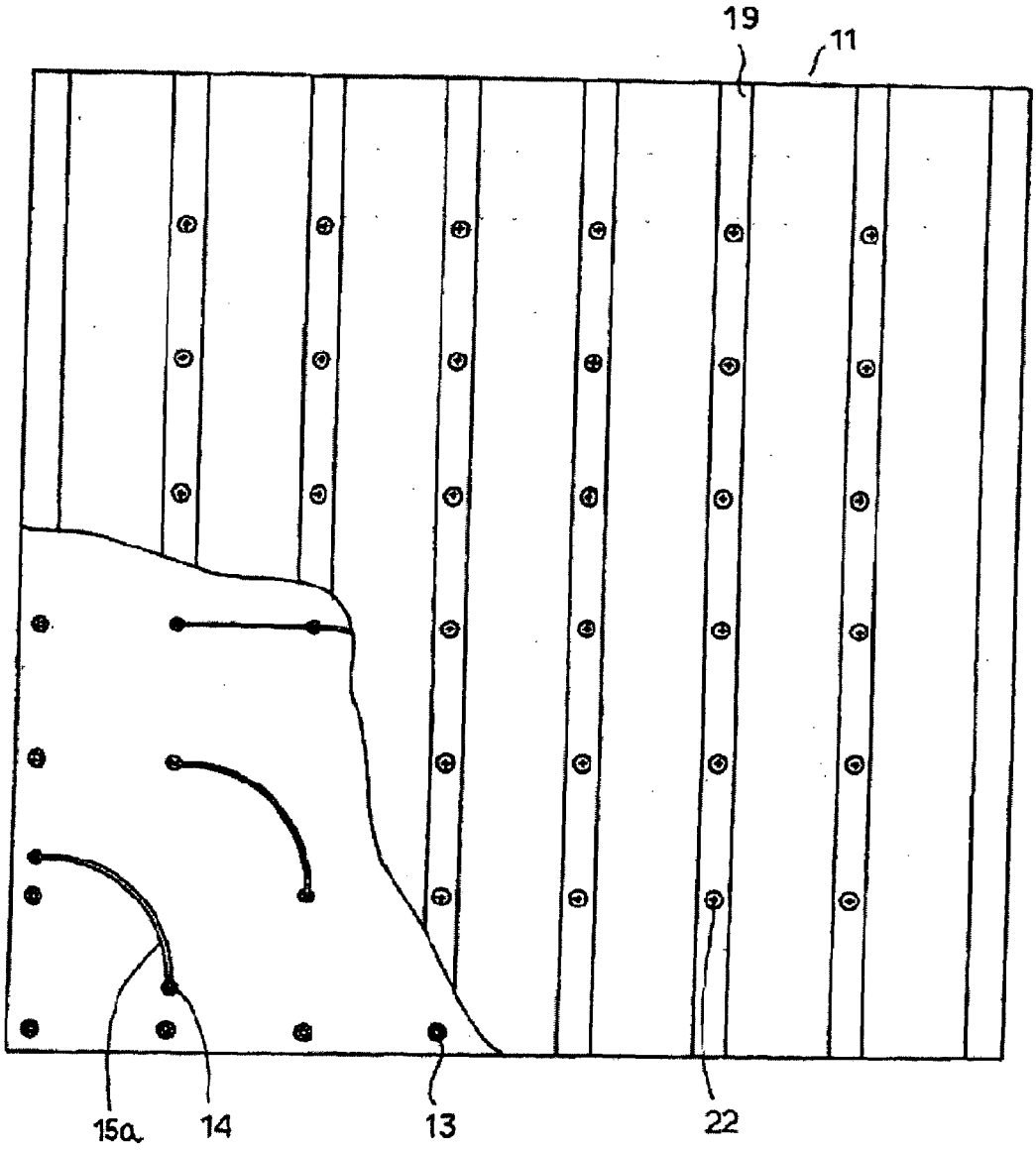
FIG. 5 is a plan view partly broken away to show the interior construction of the air hypocaust structure according to the present invention.

Referring to FIG. 5, the support legs 13 each having the hole 16 are positioned along the edge of the upper plate 11 at regular intervals, and the upper ends of the guide plates 15*a* each having the base 19 at the lower end thereof are fixed into the recess parts 17 of the upper plate 11. When the upper plate 11 integrally provided with the support legs 13 is assembled with the base plate 12 having the projections 14 including the sharp tips 18, the sharp tips 18 of the projections 14 are engaged into the holes 16 of the support legs 13 of the upper plate 11 as the projections 14 correspond in position to the support legs 13, and the bases 19 of the two types of guide plates 15*a* and 15*b* come into contact with an upper side of the base plate 12, thus supporting the guide plates 15*a* and 15*b* between the two plates 11 and 12.

Figure 4A:
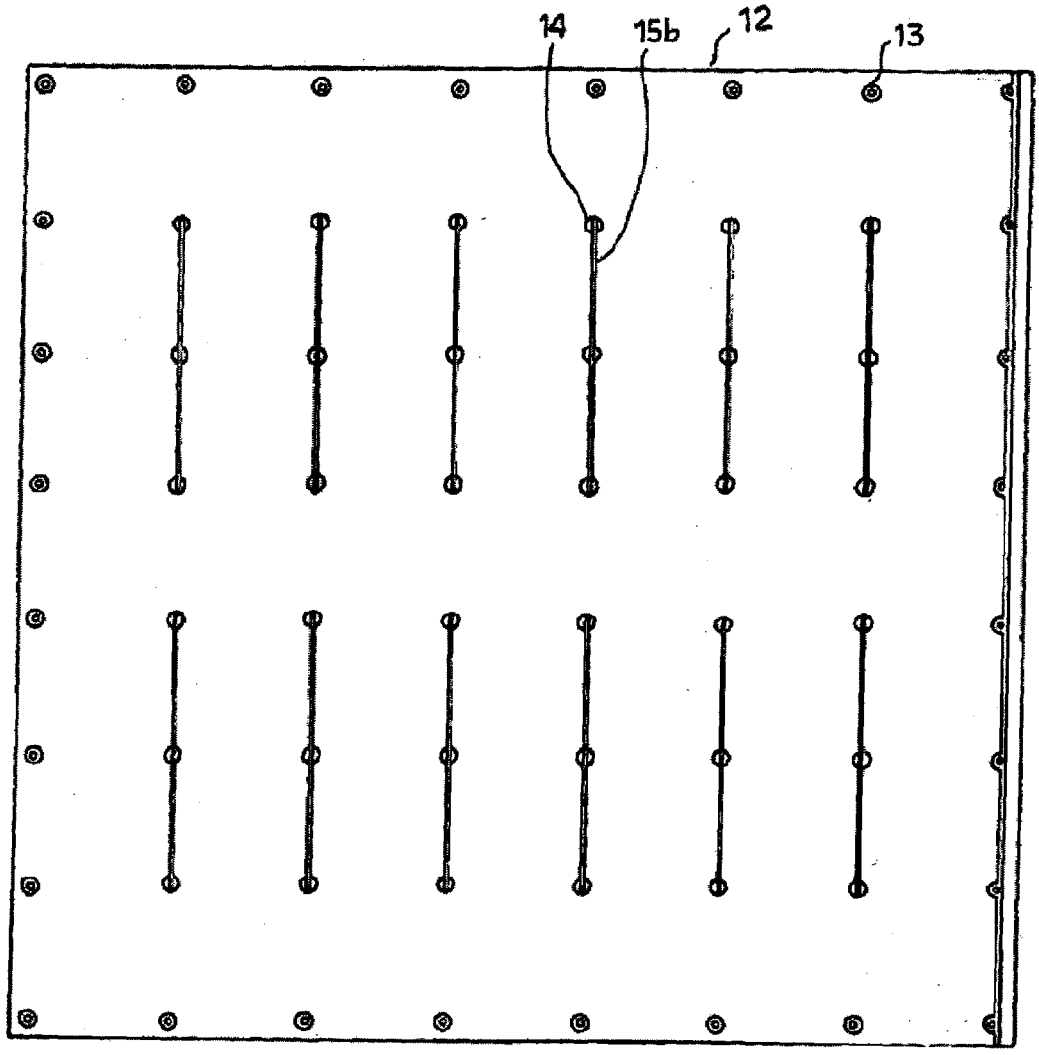
FIG. 4A is a plan view of an air hypocaust structure including a plurality of straight guide plates according to an embodiment of the present invention.
Figure 4B:
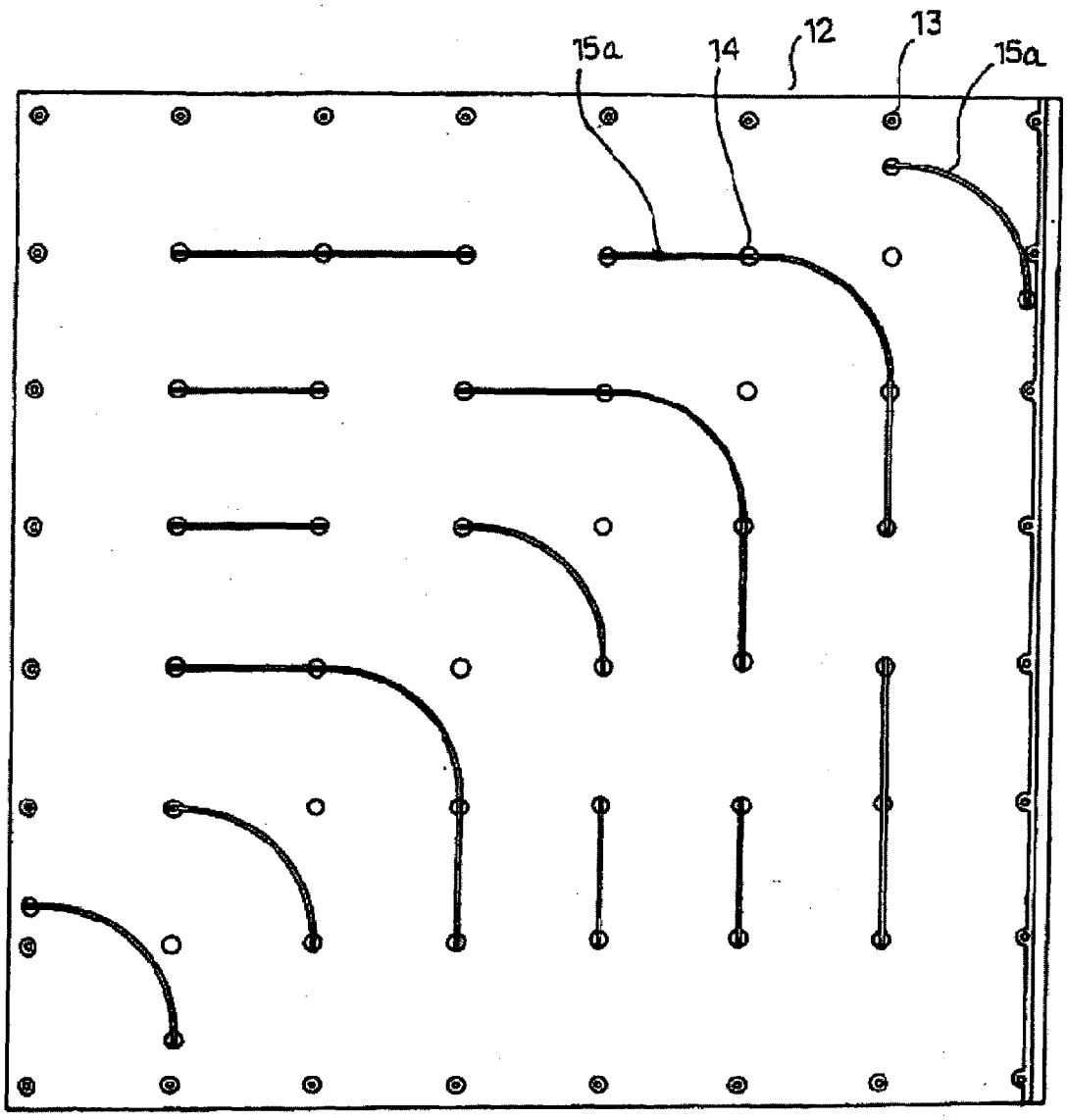
FIG. 4B is a plan view of an air hypocaust structure including a plurality of curved guide plates according to another embodiment of the present invention.

According to the present invention, the hypocaust structure may include only the straight guide plates 15*b* as shown in FIG. 4A, or the straight and curved guide plates 15*a* and 15*b* as shown in FIG. 4B. When it is required for the hot or cold air current to flow in a forward direction, only the straight guide plates 15*b* are installed in the hypocaust structure, thus the installation of the hypocaust structure in the dwelling is easily accomplished.

Conventionally, methods of heating independent buildings had been mostly developed, but recently, much effort has been made to develop a method of effectively heating town buildings. Examples of methods of heating the buildings include a heating method using hot water, a heating method using steam, and a heating method using hot air. Particularly, the heating method using the hot water has been mainly applied to dwellings.

In the case of a dwelling using the hypocaust structure, the dwelling is heated by heating a floor of the dwelling according to a conduction, a convection, and a radiation mechanism.

In the case of workrooms, such as office rooms, they are typically heated using steam or hot air. When the dwelling is heated using hot water, the floor of the dwelling is sufficiently heated, but the air in rooms of the dwelling is often not sufficiently heated. On the other hand, when the dwelling is heated using steam or hot air, the air in the rooms of the dwelling is sufficiently heated, but the floor is often not sufficiently heated.

The present invention overcomes the above disadvantages experienced in the conventional heating systems for dwellings, and selectively controls the flow direction of an air current, thereby improving the conductivity and heat transfer efficiency of the hypocaust structure.

Additionally, the hypocaust structure of the present invention is applied to different types of floors, regardless of the structures of the floors.

According to the present invention, after an insulating material is put on a floor, the base plate 12 is installed on the insulating material to prevent heat from dissipating through the floor.

In the case of using the upper plate 11 provided with both the support legs 13 and the guide plates 15*a* and 15*b* (when only the straight guide plates 15*b* are installed in the hypocaust structure, the guide plates 15*b* may be integrated with the upper plate 11), the upper plate 11 is assembled with the base plate 12 in such a way that the sharp tips 18 of the projections 14 of the base plate 12 are engaged into the holes 16 of the support legs 13 of the upper plate 11. At this time, the bases 19 of the guide plates 15*a* and 15*b* come into contact with the upper side of the base plate 12, thereby supporting the guide plates 15*a* and 15*b* between the upper and base plates 11 and 12.

The base plate 12 assembled with the upper plate 11 may be connected to another base plate. In such a case, after an insulating material is layered on the upper plates 11 of the assembled hypocaust structure, mortar is applied to the insulating material, thereby completing the installation of the hypocaust structure on the floor of the dwelling.

In the case of using the upper plate 11 integrally provided with the support legs 13 and having the recess parts 17 at a lower side thereof, the upper plate 11 is assembled with the base plate 12 in such a way that the sharp tips 18 of the projections 14 of the base plate 12 are engaged into the holes 16 of the support legs 13 of the upper plate 11. At this time, the upper ends of the guide plates 15*a* and 15*b* are fixed into the recess parts 17 of the upper plate 11, and the bases 19 of the guide plates 15*a* and 15*b* come into contact with the upper side of the base plate 12.

The base plate 12 assembled with the upper plate 11 may be connected to another base plate. In such a case, after the insulating material is layered on the upper plates 11 of the assembled hypocaust structure, mortar is applied to the insulating material, thereby accomplishing the installation of the hypocaust structure on the floor.

After the upper plate 11 is assembled with the base plate 12 to accomplish the hypocaust structure of the present invention, the hypocaust structure is connected to a main pipe (not shown), and the main pipe is connected to a main air supply system (not shown) through a connection pipe. Accordingly, a cold or hot air current is supplied from the main air supply system through the main pipe to the hypocaust structure, thus cooling and/or heating the room of the house.

As described above, the present invention is characterized in that a cold or hot air current supplied from a main air supply system circulates in a hypocaust structure while the flow direction of the air current is controlled. Since the hypocaust structure has a predetermined compact size, it is easy to assemble the hypocaust structures with each other to install the hypocaust structures on the floor of a house, and the base plate is easily assembled with the upper plate using only the support legs, guide plates, and projections. Therefore, the hypocaust structure of the present invention has advantages in that heat transfer efficiency is improved, the weight of the floor is not excessively increased because of a light weight of the hypocaust structure including the upper and base plate, and the installation costs of the hypocaust structure including the material and labor costs are reduced.

Additionally, it is possible to improve the work efficiency while the hypocaust structure is installed in the house.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An air hypocaust structure for cooling and/or heating, which transfers heat according to a conduction, a convection, and a radiation mechanism by a cold or a hot air current circulating in the air hypocaust structure, comprising:

an upper plate integrally provided with a plurality of support legs each having a hole at an end thereof;

a base plate integrally provided along an edge thereof with a plurality of projections each having a sharp tip and positioned at regular intervals to correspond to the support legs of the upper plate;

a plurality of guide plates mated to recess parts formed on the lower side of the upper plate; and a plurality of recess parts formed on a lower side of the upper plate at regular intervals to correspond in position to the guide plates, and a plurality of protrusion parts formed on an upper side of the upper plate at regular intervals to correspond in position to the recess parts.

2. The air hypocaust structure as set forth in claim 1, wherein upper ends of the plurality of guide plates are fixed into said recess parts of the lower side of the upper plate, and a flow direction of the cold or hot air current is changed by the guide plates.

3. The air hypocaust structure as set forth in claim 2, further comprising a base, wherein the base is integrally formed with a lower end of each of the guide plates, and comes into contact with an upper side of the base plate to support the guide plates between the upper plate and the base plate.

* * * * *